United States Patent [19]

Scheller

[11] Patent Number: 4,499,706

[45] Date of Patent: Feb. 19, 1985

[54] PASS THROUGH STRETCH WRAPPING PROCESS

[75] Inventor: Andor Scheller, Baytown, Tex.

[73] Assignee: Exxon Research & Engineering Co., Florham Park, N.J.

[21] Appl. No.: 496,168

[22] Filed: May 19, 1983

[51] Int. Cl.[3] ..... B65B 11/08; B65B 11/58

[52] U.S. Cl. ..... 53/399; 53/441; 53/449; 53/466

[58] Field of Search ..... 53/170, 176, 229, 397, 53/399, 441, 442, 449, 463, 466, 556, 557, 586; 383/112, 119, 908

[56] References Cited

U.S. PATENT DOCUMENTS 3,884,016 5/1975 Boström ..... 53/229 X 3,986,611 10/1976 Dreher ..... 53/399

*Primary Examiner*—Robert L. Spruill

*Assistant Examiner*—Michael D. Folkerts

*Attorney, Agent, or Firm*—R. L. Graham

[57] ABSTRACT

A double layer thermoplastic film is used in Pass-Through stretch wrapping of goods. The double layer improves the tear resistance and puncture resistance of the film.

10 Claims, 7 Drawing Figures

PASS THROUGH STRETCH WRAPPING PROCESS

BACKGROUND

1. Field of the Invention

This invention relates to a process for stretch wrapping of articles with thermoplastic film. In one aspect it relates to packaging of articles by stretch wrap pass through technique (herein referred to as "Pass-Through" process).

2. Description of the Prior Art

The packaging of articles by the Pass-Through process has been employed for several years to facilitate transportation and storage of bulky articles. The technique is normally carried out on articles stacked on a pallet wherein the loaded pallet is conveyed through a film dispensing and film stretching apparatus. As the pallet moves through the apparatus, the film is stretched and wrapped around the front and opposite sides of the loaded pallet and joined by heat seal on the rear side thereof. The goods thus are anchored to the pallet in an integrated body which facilitates transportation and storage, as well as providing protection for the goods.

The thermoplastic film used in such operations must possess strength as well as high degree of stretching and resist tear as the film is stretched around corners of the stacked goods. Films that have been used in such operations include conventional high pressure low density polyethylene and low pressure linear low density polyethylene. These films are normally used in a single layer and have sufficient thickness to permit substantial stretching.

In stretch wrapping by the Pass-Through process, most film failures occur at the top or bottom corners of the load, mainly due to the film's inability to slide around corners. If the film sticks or hangs up on a corner, it will most likely become punctured by the corner and tear in the transverse direction as the stretching tension is increased.

Stretch films usable in the Pass-Through process thus must possess the following properties: a relative high degree of stretch, transverse direction tear resistance, puncture resistance, and a medium slip.

A variety of thermoplastic films, including ethylene homo and copolymers and blends thereof, have been used in packaging by the Pass-Through process. These films, however, have been used in a single layer of sufficient thickness to provide the necessary strength properties identified above. The recent advent of commercial linear low density polyethylene (LLDPE) is particularly suited for stretch wrapping. The short chain branching of the LLDPE molecules permit the LLDPE film to be more easily stretched than polymers with long chain branching such as conventional high pressure polyethylene (LDPE).

As will be discussed in more detail below, the present invention employs a double layer of polyethylene film. The prior art which discloses the use of multi-layer films includes U.S. Pat. Nos. 4,160,053, 4,303,710, 4,228,215, 4,329,388, 4,294,889, 4,132,050, 4,297,411, and 4,258,848. These references, however, generally relate to laminates or blocked film layers. None of these references disclose the use of such films in the packaging operation using Pass-Through process.

SUMMARY OF THE INVENTION

The present invention provides an improved method for packaging goods by the Pass-Through stretch film technique which results in a more secure bundle. Briefly, the method comprises stretching a double layer film (preferably a flattened tube), web or curtain around the front and sides of goods to be packaged with the film under tension, joining the curtain on the rear side of the goods by heat sealing in accordance with Pass-Through packaging process. The composition of the film may be that of any thermoplastic stretch film currently used in Pass-Through packaging. However, it is preferred that LLDPE be used. LLDPE is characterized in that (a) it has sufficient stretch ability to provide the stretch wrap required in the packaging process, and (b) it has excellent physical properties to resist tear and puncture. Moreover, the slip charactistics between the double film layer may be achieved such that in stretching the film around the goods to be packaged, the outer film layer tends to slide over the inner film layer. This feature is particularly advantageous in applying the film around sharp corners. The inner film layer may not readily pass around the corners but provides a lubricating surface for the outer film to pass therearound.

The tubular form of the film may be obtained by the use of conventional blown film process. The tubular film is flattened to provide the dual layer for use in the packaging process. Due to rotation, the film inherently results in the cross alignment of molecules between layers which have been oriented during the film blowing process. Although the molecular orientation is generally in the machine direction, there is nevertheless sufficient molecular chain cross-alignment between the layers when flattened to result in the resistance to tear. This feature is particularly important in stretch film packaging because the handling and transportation frequently results in film puncture. Puncture of the double layer film, unlike a single film, resists tear because tear propagation of the two layers is in divergent directions.

The double layers also provide puncture resistance. Since the layers are separate, puncturing of the inner film will not necessarily puncture the outer film because of its tendency to yield.

Experience has shown that te tear resistance and puncture resistance during the stretch-wrap operation of the double layer are significantly higher than comparable properties of a single layer of the same thickness as the double layer. Because of these improved properties, the combined thickness of the two layers may be less than the single layer to achieve the same results.

The two single layers also exhibit better pliability and flexibility than a single layer of the same thickness.

In another embodiment of the invention, gussets are formed on opposite sides of the tube during the flattening process. During the packaging process, the gussets are aligned with the bottom and top of the goods to be bundled together. The gusseted portions provide additional reinforcement in the areas which are subjected to the greatest damage. The gusseted portion also aids in securing the goods to the support base such as a pallet.

DESCRIPTION OF THE PREFERRED EMBODIMENTS

Figures 1, 2, 3, 4:
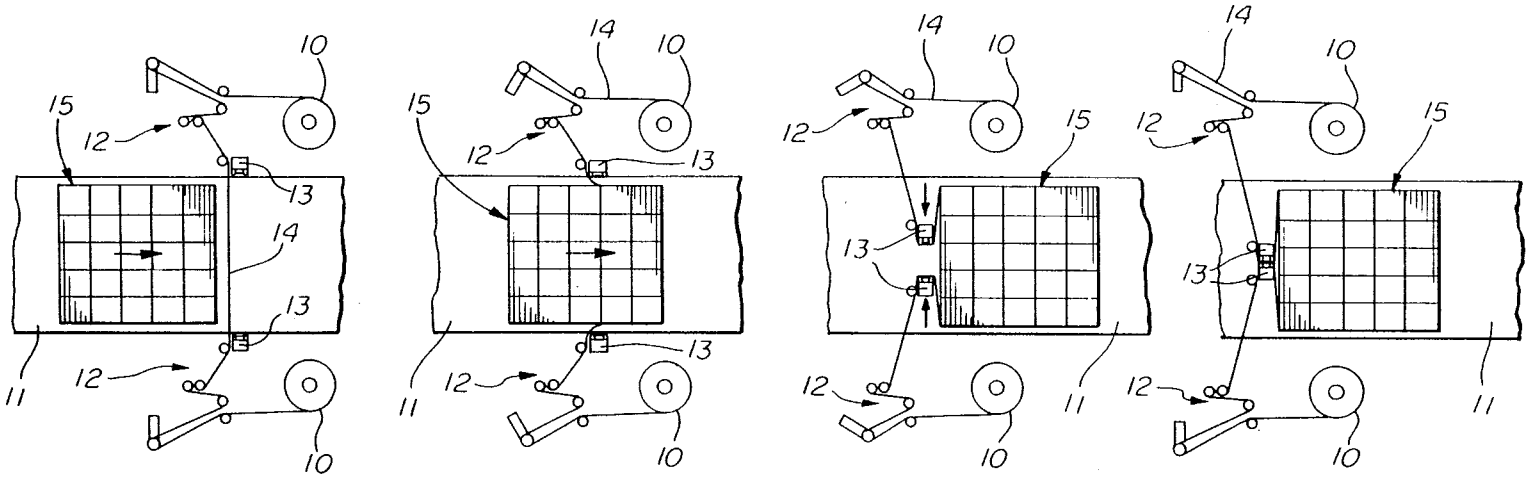
FIGS. 1–4 are plan view schematic illustrating the sequence of wrapping goods by the Pass-Through stretch process.

In order to appreciate the advantages of the present invention over the prior art, it is necessary to understand the operation of the Pass-Through packaging process illustrated in the sequence drawings 1-4. The Pass-Through equipment normally includes two rolls of film 10 positioned on opposite sides of a horizontal conveyor 11, means for dispensing and tensioning the film 12, and seal jaws 13. Film webs from each film roll are threaded through its respective dispensing and tensioning means 12 and the jaws 13, and joined at the center of the conveyor 11 forming a web or film curtain 14 there across. The load of goods to be packaged shown generally as 15 are normally stacked on a pallet 16 (not shown in FIGS. 1-4).

With reference to FIG. 1, the load 15 is shown positioned on the conveyor 11 and approaching the web 14. As the load moves into the film curtain 14 (FIG. 2), film is dispensed from the rolls 10, and stretched around opposite sides of the load 15. As the load 15 passes the spaced locking jaws 13, the conveyor 11 is automatically stopped. The sealing jaws 13 are moved inwardly as shown in FIG. 3. Unwinding of film 14 from the rolls 10 is restricted during this step such that the film 14 is stretched around the unit 15. The seal jaws 13 meet as shown in FIG. 4 at the vertical center line of the rear side of the load 15. The jaws 13 are provided with means for cutting the film and for sealing the opposite ends stretched around the load 15 and also to restore the film web across the conveyor 11. Air may be used to cool the seals. When the sealing cycle is completed the jaws 13 reopen to the position of FIG. 1 and placed in position to receive the next load.

The stretching and wrapping around the load secures the goods to the pallet and maintains them in an integrated unit.

Figure 6:
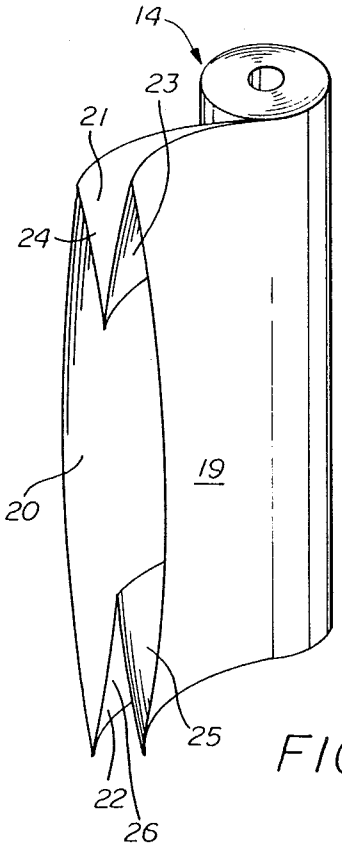
FIG. 6 is a perspective view of a roll of thermoplastic film provided with gussets.
Figure 5:
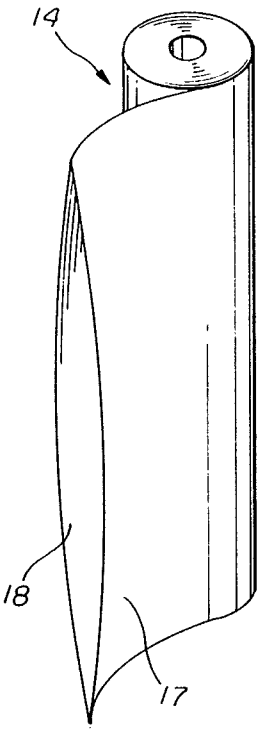
FIG. 5 is a perspective view of a roll of flattened thermoplastic film which is usable in the present invention.

The form of the film 14 usable in the Pass-Through process described above is illustrated in FIGS. 5 and 6. Referring first to FIG. 5, the film 14 is a flattened tube comprising layers 17 and 18. The film illustrated in FIG. 6 is also a flattened tube having layers 19 and 20 but also having gussets, or tucked-in portions 21 and 22, which extend longitudinally on opposite sides of the tubular film 14. The gussets provide additional layers 23 and 24 for gusset 21 and 25 and 26 for gusset 22. The function of these gussets provide reinforcement around upper and lower corners of the said loads as described in more detail below.

Although the composition of the thermoplastic film may be any stretch film presently used in Pass-Through operations, the preferred composition is a homopolymer or copolymer of ethylene or blends thereof (herein refer to as polyethylene films). Tubular polyethylene films usable in the process of the present invention are produced by blown film techniques. In this technique, the molten polyethylene is extruded through a ring shaped die and expanded into a hollow cylinder (bubble). The bubble after a few yards of free suspension is flattened between nip rollers. The flattened film then is rolled up into a roll similar to that shown in FIG. 5. In order to prevent alignment of imperfections in the film, the die or the bubble by means of the nip roll suspension is rotated or oscillated relative to one another. This rotation or oscillation causes the molecules of one layer to orient somewhat crosswise of the other layer with respect to the machine direction. Thus when the film tube is flattened by the nip rollers, the molecules of one layer will be cross aligned with the molecules of the other layer. The cross alignment of molecules aids in resisting tear of the double layer film in the transverse direction.

The preferred film is LLDPE which is produced by copolymerizing ethylene with an alpha-olefin selected from the group comprising butene-1, pentene-1, hexene-1, 4-methylpentene-1, heptene-1, and octene. The comonomers are present in amounts up to 14 wt.%. The polymerization is by low pressure process conducted using a chrominum catalyst or a Ziegler catalyst which may be performed by the gas phase method, liquid phase method, or solution method. The LLDPE produced by these methods have a density between 0.915 and 0.935, Mw/Mn ratio of 3 to 15 and an MI between 0.1 to 50 grams per 10 minutes.

LLDPE because of its lack of long chain cross branching, is ideally suited for producing film by the blown film process. Its viscosity properties permit greater draw down.

Typical properties of LLDPE film which may be used in the present invention are as follows:

| | |
|---|---|
| Film: type | LLDPE<br>LLDPE/EVA blends (with EVA up to 50%)<br>(The LLDPE was a copolymer of ethylene and butene-1 produced by gas phase process)<br>additive: 0.02% of erucamide slip agent. |

| Typical Properties: | Value | ASTM Test No. |
|---|---|---|
| Yield strength MD | 1500 psi | D-882 |
| TD | 1600 psi | |
| Ultimate Tensile MD | 6000 psi | D-882 |
| TD | 5000 psi | |
| Ultimate Elongation MD | 600% | D-882 |
| TD | 700% | D-882 |
| Secant Modulus MD | 35000 psi | D-882 |
| TD | 40000 psi | D-882 |
| Elmendorf Tear MD (double layer) | 200 g/mil | D-1922 |
| TD (double layer) | 870 g/mil | |
| Puncture Resistance | 5 in-lb/mil | Exxon |
| Haze | 10% | D-1003 |
| Coefficient of Friction % | 0.2-0.5 | D-1894 |

In providing the tubular film with the gussets, guides on opposite sides of the bubble may be used to turn portions of the bubble inwardly prior to the bubble reaching the nip rolls. The turned in portions thus are retained and flattened as the bubble passes through the nip rolls and rolled up forming a film roll as shown in FIG. 6.

In carrying out the process, film rolls 10 are placed on opposite sides of the conveyor 11 as illustrated in FIG. 1 the film 14 from each roll is threaded through the dispensing means 12 and the seal jaws 13. The jaws 13 are activated welding the ends of the films together at the center of the apparatus forming the web that extends across the conveyor. The load 15 is then conveyed through the apparatus as described previously with reference to FIGS. 1-3 and stopped automatically when the load passes the seal jaws 13. Further unwinding from the film rolls 10 is then restricted such that in actuating the seal jaws the double layered film 14 is stretched around the load 15. Note that the inner layer provides a lubricating surface for the outer layer so that sliding around the corners is greatly enhanced. Moreover, the film is permitted to slide on the top side of the load and around the pallet securing the load into an integrated unit. The degree of stretching will of course depend upon the film used but LLDPE may be stretched from 1 to 100%, preferably 10 to 50%. In apparatus equipped with pre-stretching facilities, the stretch will be generally uniform around the load. In equipment without pre-stretching facilities, the stretch may vary from front (2–5%) to back (30–70%).

In order to provide the slippage necessary between the two layers, it may be necessary to add a certain amount of slip agent such as erucamide, a long chain fatty acid amide. Tests have shown that from 0.01 to 0.05 wt.% of a slip agent is sufficient. This provides the film with a COF of between 0.2 to 0.5.

Other additives that may be incorporated include antiblock, UV stabilizers, and other typical additives for film.

Figure 7:
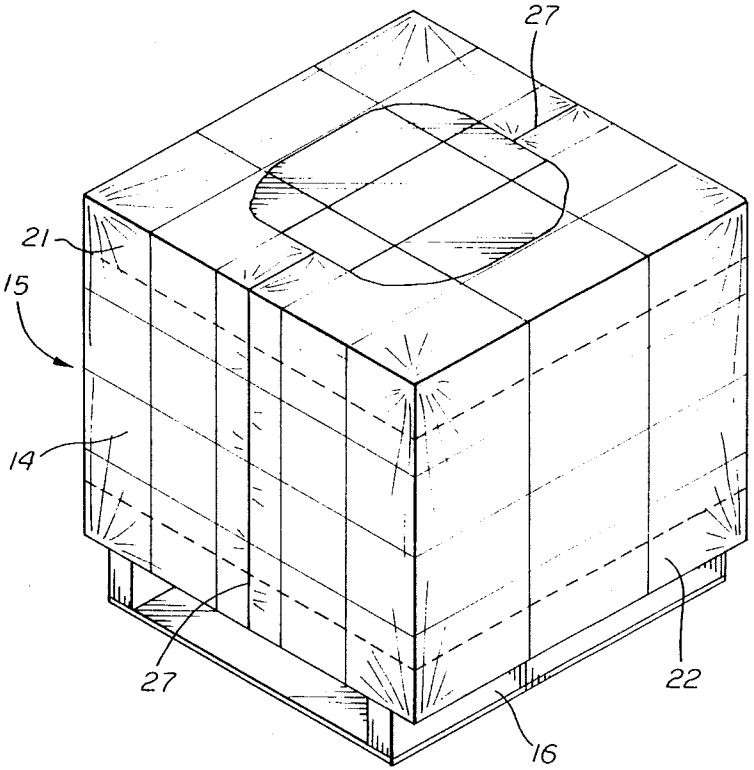
FIG. 7 is a perspective view of goods packaged by the present invention using thermoplastic film having gussets formed therein.

The thickness of each layer will depend upon the application. For most uses, thicknesses between 0.5 and 2.0 mils are satisfactory. When using the film with gussets, the package will be bundled as shown in FIG. 7. Note that the area designated by the numeral 21 provides four layers over the areas subjected to the greatest wear. Likewise, four layers are provided on the bottom area designated by numeral 22 to reinforce the film.

Line 27 represents the seal line for the film.

The following test demonstrates the superiority of the double layer of film in improved TD Elmendorf tear over a single layer of film. The film was a flattened tube of the type described above.

| Property | 2.0 Mil Single Layer | Double Layer 1.0 Mil per Layer |
|---|---|---|
| Elmendorf Tear TD | 650 g/mil | 870 g/mil |

The above test results demonstrate the superiority of the double layer over the single layer film in TD tear resistance.

Moreover, observations on the use of the tubular film in actual Pass-Through operations revealed that significantly fewer tears were experienced in comparison to use of the single layer film. Also, the double layer reduced abrasion of the film during shipment which also reduced hole initiation. For example, a layer contacting the wall of the transport vehicle can slide with respect to the layer contacting the bundled load, thereby reducing abrasion.

In summary, the double layer film significantly improves the tear resistance and puncture resistance of the film, and makes it ideally suited for Pass-Through packaging.

What is claimed is:

1. A method of bundling a body of goods which comprise stretching under tension a dual layer film of a thermoplastic circumferentially around the body, and joining the film together at a line where the film meets to encircle the body; said film having sufficient elongation to permit at least 10% stretching under tension and sufficient slip between the layers of the film to permit relative slippage, and wherein the molecules of one layer of the film are aligned generally crosswise of the molecules of the second layer of film thereby increasing tear resistance of the dual layer film.

2. The method as defined in claim 1 wherein the film is a copolymer of ethylene and an alpha-olefin and wherein each layer is no more than 2 mils thick.

3. The method as defined in claim 1 wherein the film has a coefficient of friction of between about 0.2 and 0.5.

4. In a pass through, stretch packaging process wherein two film webs joined together on one side of a body of goods to be packaged are stretched in opposite directions circumferentially around the body and with the tension retained, the web portions are joined together on the side opposite said one side by heat sealing, the improvement wherein the film webs are flattened tubes of a thermoplastic having (a) sufficient elasticity to permit said stretching and (b) sufficient slippage to permit the film layers to slide relative to one another during the stretching operation; the molecules of one layer of the tube are oriented generally crosswise of the molecules of the second layer of the tube.

5. The method of claim 4 wherein each film layer has a thickness of between 0.5 and 2.0 mils and a coefficient of friction of between 0.2 and 0.5.

6. The process of claim 1 wherein the thermoplastic is a homopolymer or copolymer of ethylene.

7. The process of claim 4 wherein the thermoplastic is a copolymer of ethylene and an alpha-olefin.

8. The process of claim 7 wherein the copolymer is produced by a low pressure process.

9. The process of claim 4 wherein the film further includes upper and lower gussets aligned to wrap around the upper portion and lower portion respectively of the goods to be packaged.

10. The process of claim 4 wherein the film comprises a flattened tube produced by the blown film method.

* * * * *